US008449058B2

(12) United States Patent
Hasenbein

(10) Patent No.: US 8,449,058 B2
(45) Date of Patent: May 28, 2013

(54) METHOD AND APPARATUS TO PROVIDE VARIABLE DROP SIZE EJECTION WITH LOW TAIL MASS DROPS

(75) Inventor: Robert Hasenbein, Enfield, NH (US)

(73) Assignee: Fujifilm Dimatix, Inc., Lebanon, NH (US)

( * ) Notice: Subject to any disclaimer, the term of this patent is extended or adjusted under 35 U.S.C. 154(b) by 433 days.

(21) Appl. No.: 12/470,389

(22) Filed: May 21, 2009

(65) Prior Publication Data

US 2009/0289978 A1 Nov. 26, 2009

Related U.S. Application Data

(60) Provisional application No. 61/055,640, filed on May 23, 2008.

(51) Int. Cl.
*B41J 29/38* (2006.01)

(52) U.S. Cl.
USPC ..... 347/11; 347/10; 347/5

(58) Field of Classification Search
USPC ..... 347/5, 9, 10, 11, 12
See application file for complete search history.

(56) References Cited

U.S. PATENT DOCUMENTS

| | | | | |
|---|---|---|---|---|
| 4,523,200 | A | 6/1985 | Howkins | |
| 4,686,539 | A * | 8/1987 | Schmidle et al. | 347/15 |
| 6,141,113 | A * | 10/2000 | Takahashi | 358/1.8 |
| 6,328,395 | B1 | 12/2001 | Kitahara et al. | |
| 6,676,238 | B2 | 1/2004 | Fujimura et al. | |
| 6,857,715 | B2 * | 2/2005 | Darling | 347/11 |
| 7,281,778 | B2 | 10/2007 | Hasenbein et al. | |
| 2006/0164450 | A1 | 7/2006 | Hoisington et al. | |
| 2006/0181557 | A1 | 8/2006 | Hoisington et al. | |
| 2008/0074451 | A1 | 3/2008 | Hasenbein et al. | |
| 2008/0170088 | A1 | 7/2008 | Letendre et al. | |

OTHER PUBLICATIONS

PCT International Search Report for PCT Patent Application No. PCT/US2009/045017, dated Oct. 30, 2009, 8 pgs.

PCT Written Opinion of the International Searching Authority for PCT Patent Application No. PCT/US2009/045017, dated Oct. 30, 2009, 3 pgs.

International Preliminary Report on Patentability for PCT/US2009/045017 mailed Nov. 23, 2010, 4 pages.

* cited by examiner

*Primary Examiner* — Lam S Nguyen

(74) *Attorney, Agent, or Firm* — Blakely, Sokoloff, Taylor & Zafman LLP

(57) ABSTRACT

Described herein is a method and apparatus for driving a drop ejection device to produce variable sized drops with multi-pulse waveforms. In one embodiment, a method for driving a drop ejection device having an actuator includes applying a multi-pulse waveform having at least one drive pulse and at least one break off pulse to the actuator. The method further includes building a drop of a fluid with the at least one drive pulse. The method further includes accelerating the break off of the drop with the at least one break off pulse. The method further includes causing the drop ejection device to eject the drop of a fluid in response to the pulses of the multi-pulse waveform. The break off pulse causes the break off of the drop formed by the at least one drive pulse in order to reduce the tail mass of the drop.

22 Claims, 9 Drawing Sheets

METHOD AND APPARATUS TO PROVIDE VARIABLE DROP SIZE EJECTION WITH LOW TAIL MASS DROPS

This application is related to co-pending U.S. Provisional Patent Application No. 61/055,640, which was filed on May 23, 2008; this application claims the benefit of the provisional's filing date under 35 U.S.C. §119(e) and is hereby incorporated herein by reference in its entirety.

TECHNICAL FIELD

Embodiments of the present invention relate to drop ejection, and more specifically to providing low tail mass drops.

BACKGROUND

Drop ejection devices are used for a variety of purposes, most commonly for printing images on various media. They are often referred to as ink jets or ink jet printers. Drop-on-demand drop ejection devices are used in many applications because of their flexibility and economy. Drop-on-demand devices eject one or more drops in response to a specific signal, usually an electrical waveform, or waveform, that may include a single pulse or multiple pulses. Different portions of a multi-pulse waveform can be selectively activated to produce the drops. One or more drive pulses build a drop and one or more break off pulses initiate the break off of the drop from a nozzle of the drop ejection device.

Drop ejection devices typically include a fluid path from a fluid supply to a nozzle path. The nozzle path terminates in a nozzle opening from which drops are ejected. Drop ejection is controlled by pressurizing fluid in the fluid path with an actuator, which may be, for example, a piezoelectric deflector, a thermal bubble jet generator, or an electrostatically deflected element. A typical printhead has an array of fluid paths with corresponding nozzle openings and associated actuators, and drop ejection from each nozzle opening can be independently controlled. In a drop-on-demand printhead, each actuator is fired to selectively eject a drop at a specific target pixel location as the printhead and a substrate are moved relative to one another. A drop's mass is distributed in the head and tail of the drop. Drop "tail" refers to the filament of fluid connecting the drop head, or leading part of the drop to the nozzle until tail break off occurs. Drop tails often travel slower than the lead portion of the drop. In some cases, drop tails can form satellites, or separate drops, that do not land at the same location as the main body of the drop. Thus, drop tails can degrade overall ejector performance.

SUMMARY

Described herein is a method and apparatus for driving a drop ejection device to produce variable sized drops with multi-pulse waveforms. In one embodiment, a method for driving a drop ejection device having an actuator includes applying a multi-pulse waveform having at least one drive pulse and at least one break off pulse to the actuator. The method further includes building a drop of a fluid with the at least one drive pulse. The method further includes accelerating the break off of the drop with the at least one break off pulse. The method further includes causing the drop ejection device to eject the drop of a fluid in response to the pulses of the multi-pulse waveform. The break off pulse causes the break off of the drop formed by the at least one drive pulse in order to reduce the tail mass of the drop.

BRIEF DESCRIPTION OF THE DRAWINGS

The present invention is illustrated by way of example, and not by way of limitation, in the figures of the accompanying drawings and in which.

DETAILED DESCRIPTION

Described herein is a method and apparatus for driving a drop ejection device to produce variable sized drops with multi-pulse waveforms. In one embodiment, a method for driving a drop ejection device having an actuator includes applying a multi-pulse waveform having at least one drive pulse and at least one break off pulse to the actuator. The method further includes building a drop of a fluid with the at least one drive pulse. The method further includes accelerating the break off of the drop with the at least one break off pulse. The break off pulse accelerates the break off of the drop without forming a sub-drop or satellite because a jet velocity response (e.g., ejection drop velocity) of the drop ejection device is approximately zero for the break off pulse. The method further includes causing the drop ejection device to eject the drop in response to the pulses of the multi-pulse waveform. The break off pulse causes the break off of the drop formed by the at least one drive pulse in order to reduce, and potentially, minimize the tail mass of the drop. This will improve image quality and product quality for printing applications.

In some embodiments, the drop ejection device ejects additional drops of the fluid in response to the pulses of the multi-pulse waveform or in response to pulses of additional multi-pulse waveforms.

Figure 1:
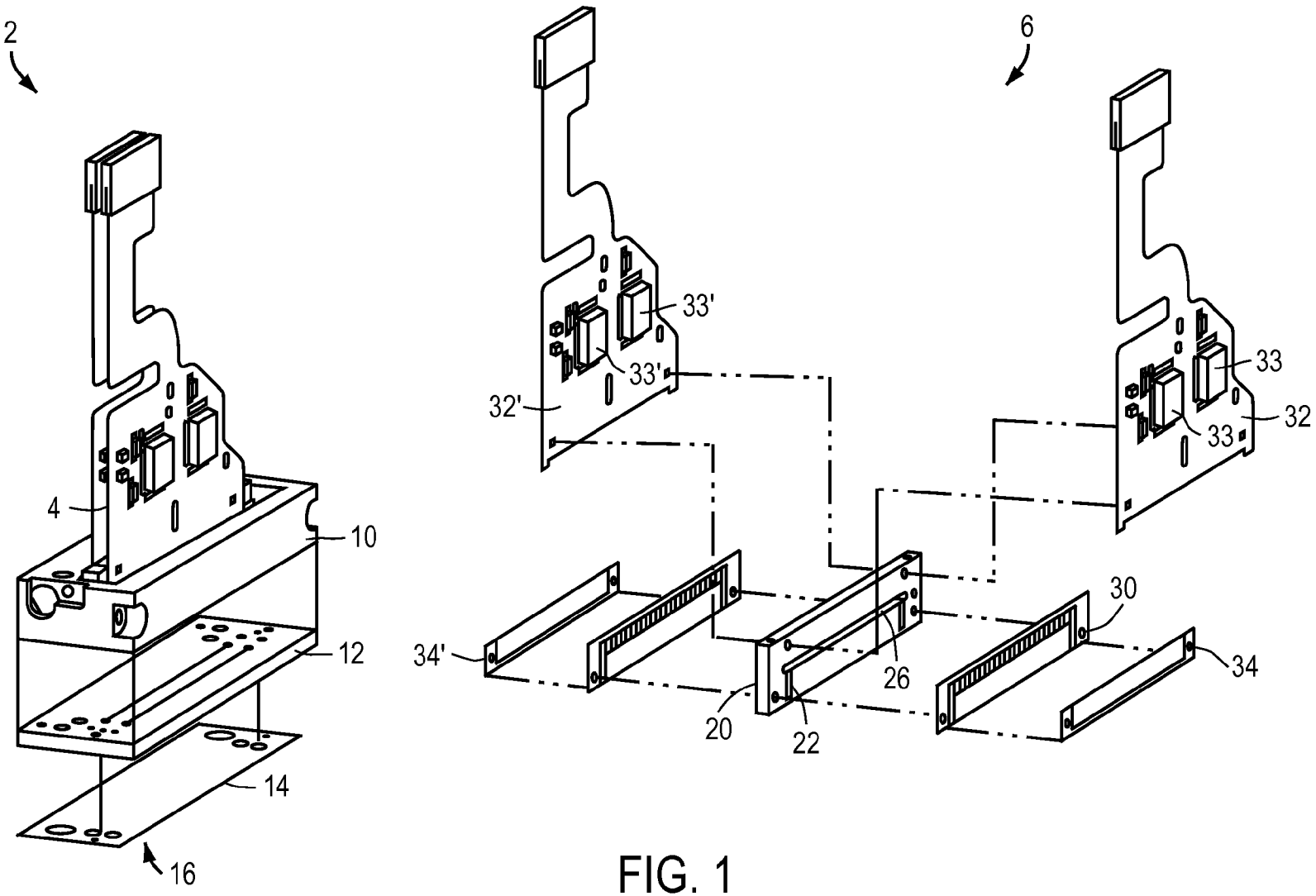
FIG. 1 is an exploded view of a shear mode piezoelectric ink jet print head in accordance with one embodiment.

FIG. 1 is an exploded view of a shear mode piezoelectric ink jet print head in accordance with one embodiment. Referring to FIG. 1, a piezoelectric ink jet head 2 includes multiple modules 4, 6 which are assembled into a collar element 10 to which is attached a manifold plate 12, and an orifice plate 14. The piezoelectric ink jet head 2 is one example of various types of print heads. Ink is introduced through the collar 10 to the jet modules which are actuated with multi-pulse waveforms to jet ink drops of various drop sizes (e.g., 30 nanograms, 50 nanograms, 80 nanograms) from the orifices 16 on the orifice plate 14 in accordance with one embodiment. Each of the ink jet modules 4, 6 includes a body 20, which is formed of a thin rectangular block of a material such as sintered carbon or ceramic. Into both sides of the body are machined a series of wells 22 which form ink pumping chambers. The ink is introduced through an ink fill passage 26 which is also machined into the body.

The opposing surfaces of the body are covered with flexible polymer films 30 and 30' that include a series of electrical contacts arranged to be positioned over the pumping chambers in the body. The electrical contacts are connected to leads, which, in turn, can be connected to flex prints 32 and 32' including driver integrated circuits 33 and 33'. The films 30 and 30' may be flex prints. Each flex print film is sealed to the body 20 by a thin layer of epoxy. The epoxy layer is thin enough to fill in the surface roughness of the jet body so as to provide a mechanical bond, but also thin enough so that only a small amount of epoxy is squeezed from the bond lines into the pumping chambers.

Each of the piezoelectric elements 34 and 34', which may be a single monolithic piezoelectric transducer (PZT) member, is positioned over the flex prints 30 and 30'. Each of the piezoelectric elements 34 and 34' have electrodes that are formed by chemically etching away conductive metal that has been vacuum vapor deposited onto the surface of the piezoelectric element. The electrodes on the piezoelectric element are at locations corresponding to the pumping chambers. The electrodes on the piezoelectric element electrically engage the corresponding contacts on the flex prints 30 and 30'. As a result, electrical contact is made to each of the piezoelectric elements on the side of the element in which actuation is effected. The piezoelectric elements are fixed to the flex prints by thin layers of epoxy.

Figure 2:
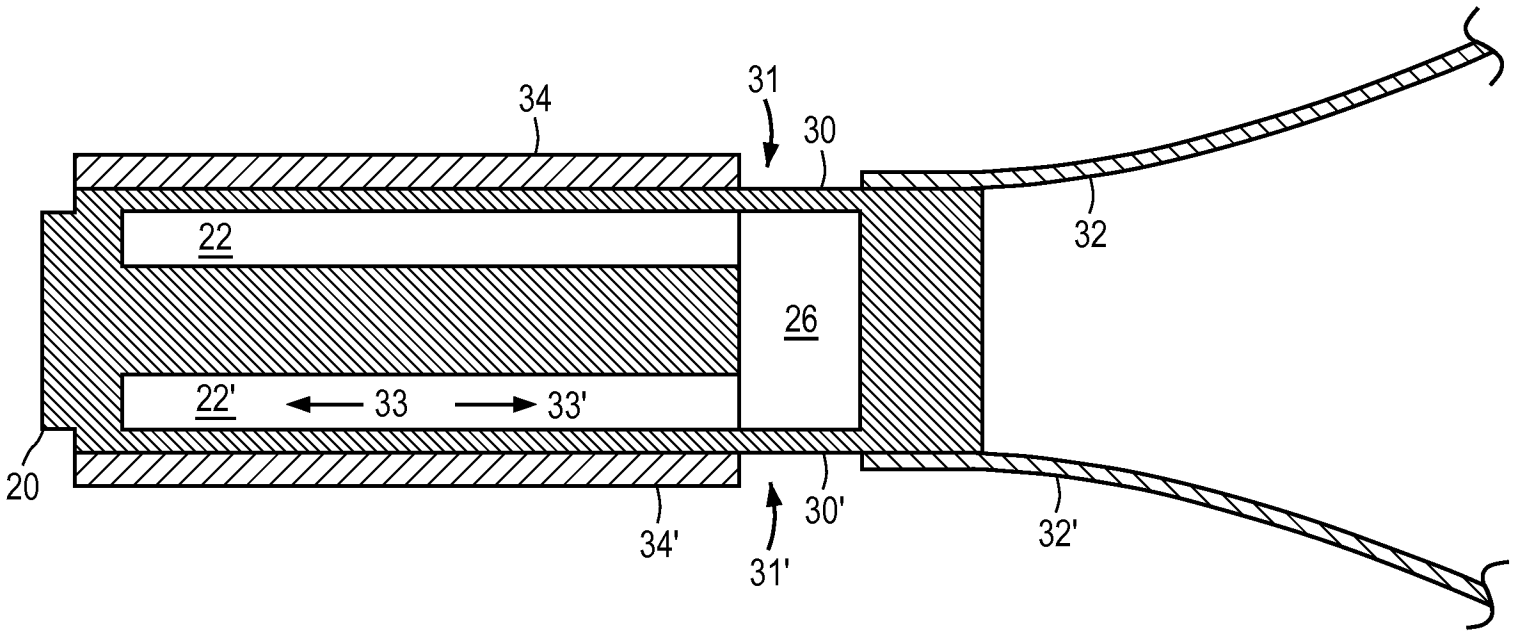
FIG. 2 is a cross-sectional side view through an ink jet module in accordance with one embodiment.

FIG. 2 is a cross-sectional side view through an ink jet module in accordance with one embodiment. Referring to FIG. 2, the piezoelectric elements 34 and 34' are sized to cover only the portion of the body that includes the machined ink pumping chambers 22. The portion of the body that includes the ink fill passage 26 is not covered by the piezoelectric element.

The ink fill passage 26 is sealed by a portion 31 and 31' of the flex print, which is attached to the exterior portion of the module body. The flex print forms a non-rigid cover over (and seals) the ink fill passage and approximates a free surface of the fluid exposed to atmosphere.

Crosstalk is unwanted interaction between jets. The firing of one or more jets may adversely affect the performance of other jets by altering jet velocities or the drop volumes jetted. This can occur when unwanted energy is transmitted between jets.

In normal operation, the piezoelectric element is actuated first in a manner that increases the volume of the pumping chamber, and then, after a period of time, the piezoelectric element is deactuated so that it returns to its original position. Increasing the volume of the pumping chamber causes a negative pressure wave to be launched. This negative pressure starts in the pumping chamber and travels toward both ends of the pumping chamber (towards the orifice and towards the ink fill passage as suggested by arrows 33 and 33'). When the negative wave reaches the end of the pumping chamber and encounters the large area of the ink fill passage (which communicates with an approximated free surface), the negative wave is reflected back into the pumping chamber as a positive wave, traveling towards the orifice. The returning of the piezoelectric element to its original position also creates a positive wave. The timing of the deactuation of the piezoelectric element is such that its positive wave and the reflected positive wave are additive when they reach the orifice.

Figure 3:
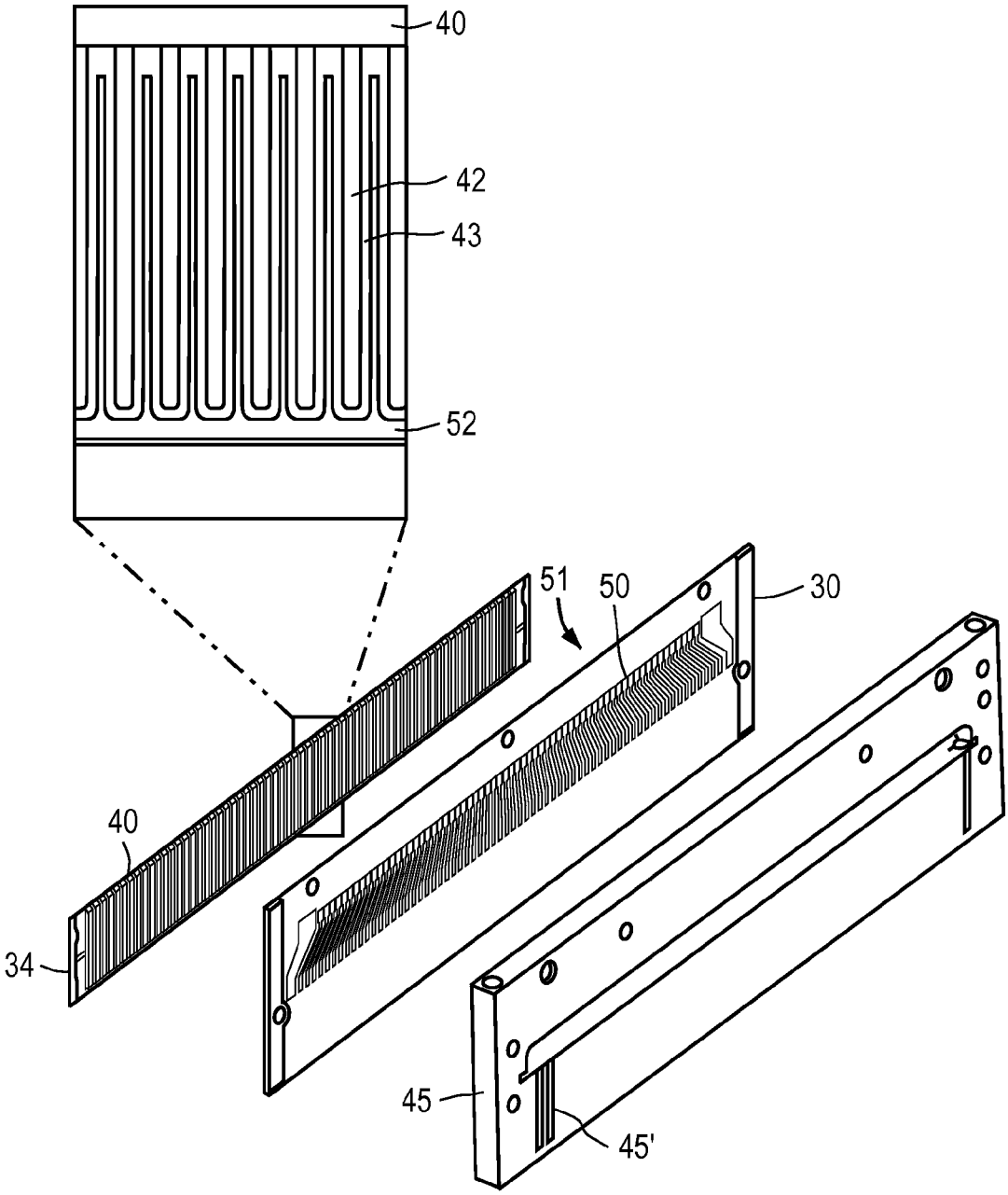
FIG. 3 is a perspective view of an ink jet module illustrating the location of electrodes relative to the pumping chamber and piezoelectric element in accordance with one embodiment.

FIG. 3 is a perspective view of an ink jet module illustrating the location of electrodes relative to the pumping chamber and piezoelectric element in accordance with one embodiment. Referring to FIG. 3, the electrode pattern 50 on the flex print 30 relative to the pumping chamber and piezoelectric element is illustrated. The piezoelectric element has electrodes 40 on the side of the piezoelectric element 34 that comes into contact with the flex print. Each electrode 40 is placed and sized to correspond to a pumping chamber 45 in the jet body. Each electrode 40 has an elongated region 42, having a length and width generally corresponding to that of the pumping chamber, but shorter and narrower such that a gap 43 exists between the perimeter of electrode 40 and the sides and end of the pumping chamber. These electrode regions 42, which are centered on the pumping chambers, are the drive electrodes. A comb-shaped second electrode 52 on the piezoelectric element generally corresponds to the area outside the pumping chamber. This electrode 52 is the common (ground) electrode.

The flex print has electrodes 50 on the side 51 of the flex print that comes into contact with the piezoelectric element. The flex print electrodes and the piezoelectric element electrodes overlap sufficiently for good electrical contact and easy alignment of the flex print and the piezoelectric element. The flex print electrodes extend beyond the piezoelectric element (in the vertical direction in FIG. 3) to allow for a soldered connection to the flex print 32 that contains the driving circuitry. It is not necessary to have two flex prints 30 and 32. A single flex print can be used.

Figure 4B:
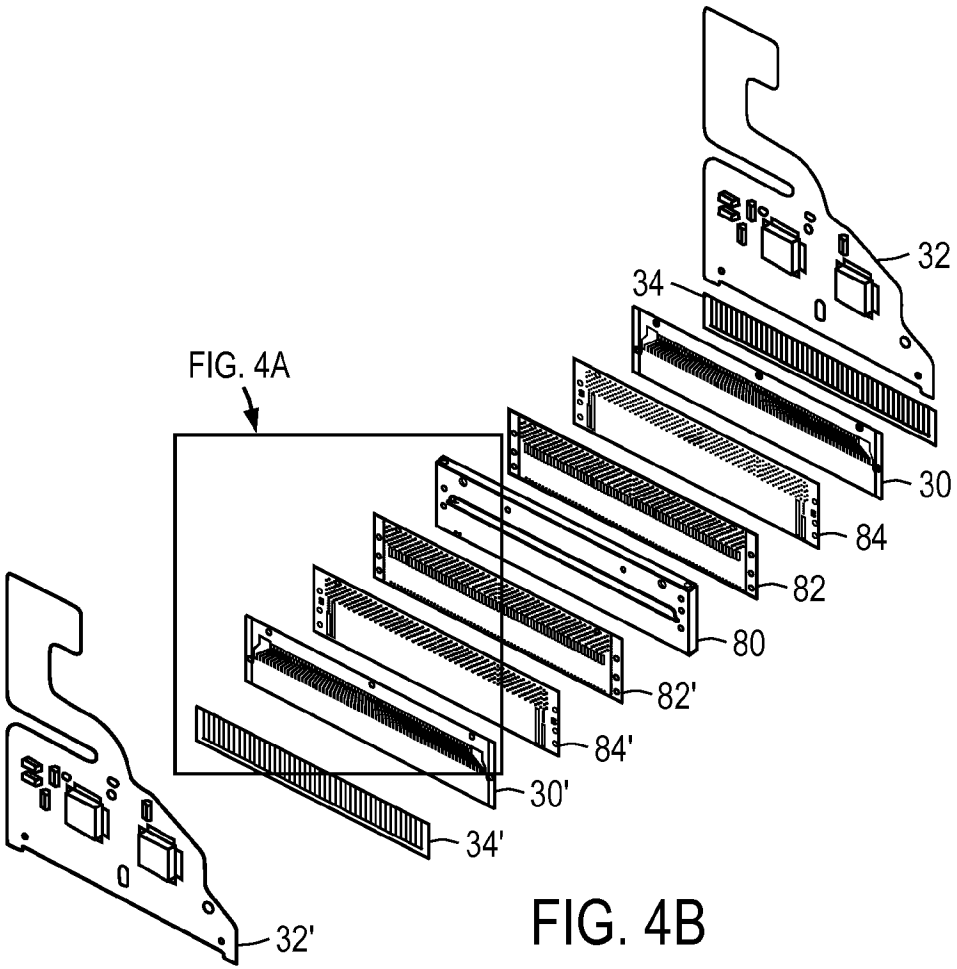
FIG. 4A is an exploded view of another embodiment of an ink jet module illustrated in FIG. 4B.
Figure 4A:
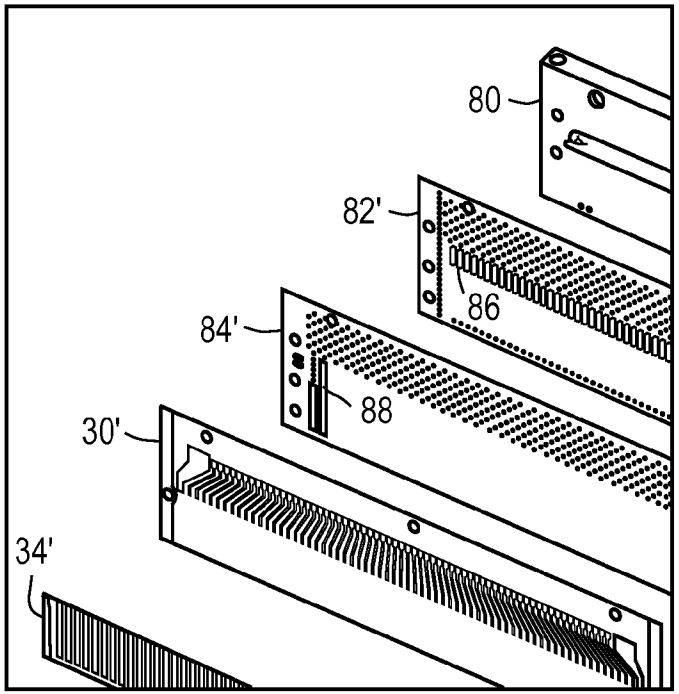

FIG. 4A is an exploded view of another embodiment of an ink jet module illustrated in FIG. 4B. In this embodiment, the jet body is comprised of multiple parts. The frame of the jet body 80 is sintered carbon and contains an ink fill passage. Attached to the jet body on each side are stiffening plates 82 and 82', which are thin metal plates designed to stiffen the assembly. Attached to the stiffening plates are cavity plates 84 and 84', which are thin metal plates into which pumping chambers have been chemically milled. Attached to the cavity plates are the flex prints 30 and 30', and to the flex prints are attached the piezoelectric elements 34 and 34'. All these elements are bonded together with epoxy. The flex prints that contain the drive circuitry 32 and 32', are attached by a soldering process.

Figure 5:
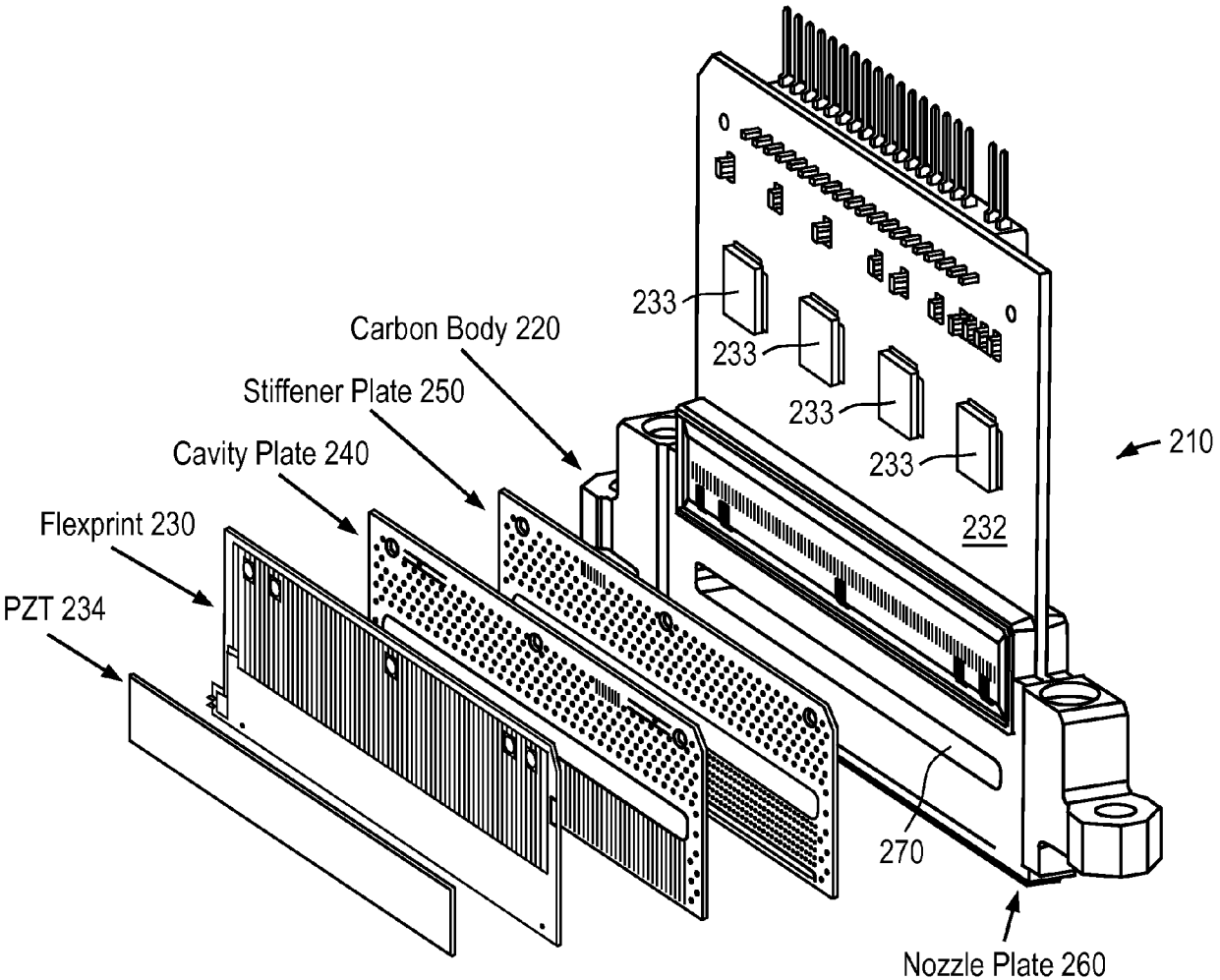
FIG. 5 is a shear mode piezoelectric ink jet print head in accordance with another embodiment.

FIG. 5 is a shear mode piezoelectric ink jet print head in accordance with another embodiment. The ink jet print head illustrated in FIG. 5 is similar to the print head illustrated in FIG. 1. However, the print head in FIG. 5 has a single ink jet module 210 in contrast to the dual ink jet modules 4 and 6 in FIG. 1. In some embodiments, the ink jet module 210 includes the following components: a carbon body 220, stiffener plate 250, cavity plate 240, flex print 230, PZT member 234, nozzle plate 260, ink fill passage 270, flex print 232, and drive electronic circuits 233. These components have similar functionality as those components described above in conjunction with FIGS. 1-4.

Figure 6:
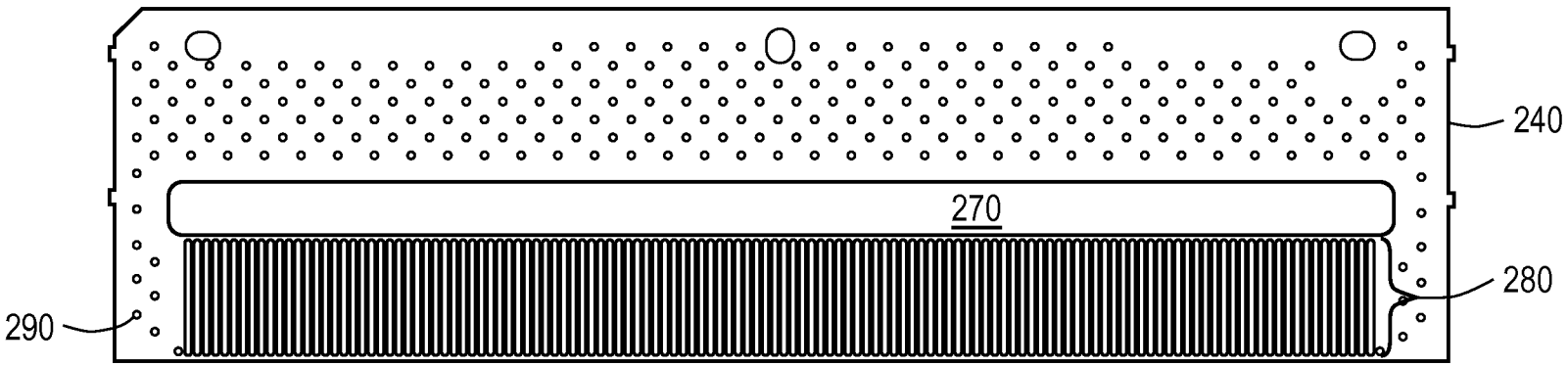
FIG. 6 is a perspective view of an ink jet module illustrating a cavity plate in accordance with one embodiment.

A cavity plate is illustrated in more detail in FIG. 6 in accordance with one embodiment. The cavity plate 240 includes holes 290, ink fill passage 270, and pumping chambers 280 that are distorted or actuated by the PZT 234. The ink jet module 210 which may be referred to as a drop ejection device includes a pumping chamber as illustrated in FIGS. 5 and 6. The PZT member 234 (e.g., actuator) is configured to vary the pressure of fluid in the pumping chambers in response to the drive pulses applied to the drive electronics 233. For one embodiment, the PZT member 234 ejects drops of a fluid from the pumping chambers. The drive electronics 233 are coupled to the PZT member 234. During operation of the ink jet module 210, the drive electronics 233 drive the PZT member 234 with a multi-pulse waveform having at least one drive pulse and at least one break off pulse. The at least one drive pulse builds a drop of a fluid. The at least one break off pulse accelerates the break off of the drop. The at least one break off pulse accelerates the break off of the drop without forming a sub-drop or satellite because a jet velocity response (e.g., drop ejection velocity) of the drop ejection device is approximately zero. The break off pulse travels to a nozzle of the drop ejection device and accelerates the break off of this drop that is already forming. The at least one break off pulse causes the break off of the drop formed by the at least one drive pulse in order to reduce the tail mass of the drop.

Figure 7:
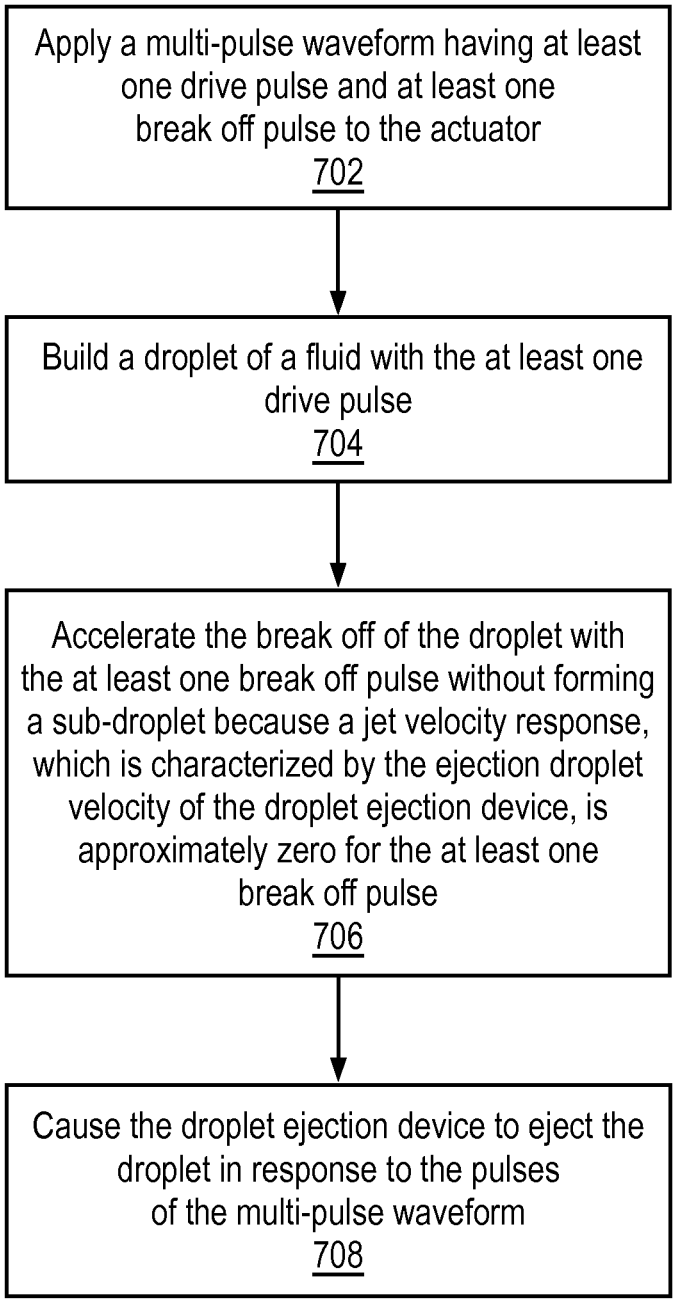
FIG. 7 illustrates a flow diagram of an embodiment for driving a drop ejection device with a multi-pulse waveform to produce a low tail mass drop.

FIG. 7 illustrates a flow diagram of a process for driving a drop ejection device with a multi-pulse waveform to produce a low tail mass drop in accordance with one embodiment. The process for driving a drop ejection device having an actuator includes applying a multi-pulse waveform having at least one drive pulse and at least one break off pulse to the actuator at processing block 702. Then, the process includes building a drop of a fluid with the at least one drive pulse at processing block 704. Next, the process includes accelerating the break off of the drop with the at least one break off pulse at processing block 706. The break off pulse accelerates the break off of the drop without forming a sub-drop or satellite because a jet velocity response, which is characterized by the ejection drop velocity of the drop ejection device, is approximately zero for the at least one break off pulse. The process also includes causing the drop ejection device to eject the drop in response to the pulses of the multi-pulse waveform at processing block 708. The break off pulse causes the break off of the drop formed by the at least one drive pulse in order to reduce the tail mass of the drop.

In one embodiment, the drop ejection device ejects additional drops of the fluid in response to the pulses of the multi-pulse waveform or in response to pulses of additional multi-pulse waveforms. A waveform may include a series of sections that are concatenated together. Each section may include a certain number of samples that include a fixed time period (e.g., 1 to 3 microseconds) and associated amount of data. The time period of a sample is long enough for control logic of the drive electronics to enable or disable each jet nozzle for the next waveform section. The waveform data is stored in a table as a series of address, voltage, and flag bit samples and can be accessed with software. A waveform provides the data necessary to produce a single sized drop and various different sized drops.

Complex multi-pulse waveforms can be used to produce larger drops for a given size drop ejector. One of the benefits that has been identified from producing large drops with this method is that the drops tend to have a much higher fraction of the drop mass in the head of the drop. This is a result, in part, of the fact that the tail mass is controlled by the size of the nozzle, which is smaller, for the ejector that is using the complex waveform to produce the drop. Another reason is that the drop formation process is being interrupted by the sequence of pulses (e.g., break off pulse(s)) that are used to produce the drop. This interferes with a smooth separation of a tail from the nozzle, and reduces the mass in the tail.

It is desirable for as much mass as possible to be in the head and not the tail of the drop. This will improve image quality and product quality. Drop tails can be reduced by multi-pulse drop firing because the impact of successive volumes of fluid changes the character of drop formation. Later pulses of the multi-pulse waveform drive fluid into fluid driven by earlier pulses of the multi-pulse waveform, which is at the nozzle exit, forcing the fluid volumes to mix and spread due to their different velocities. This mixing and spreading can prevent a wide filament of fluid from connecting at the full diameter of the drop head, back to the nozzle. A multi-pulse waveform as illustrated in FIG. 8 produces drops that have either no tails or a very thin filament, as opposed to the conical tails often observed in single pulse waveforms.

Figure 8:
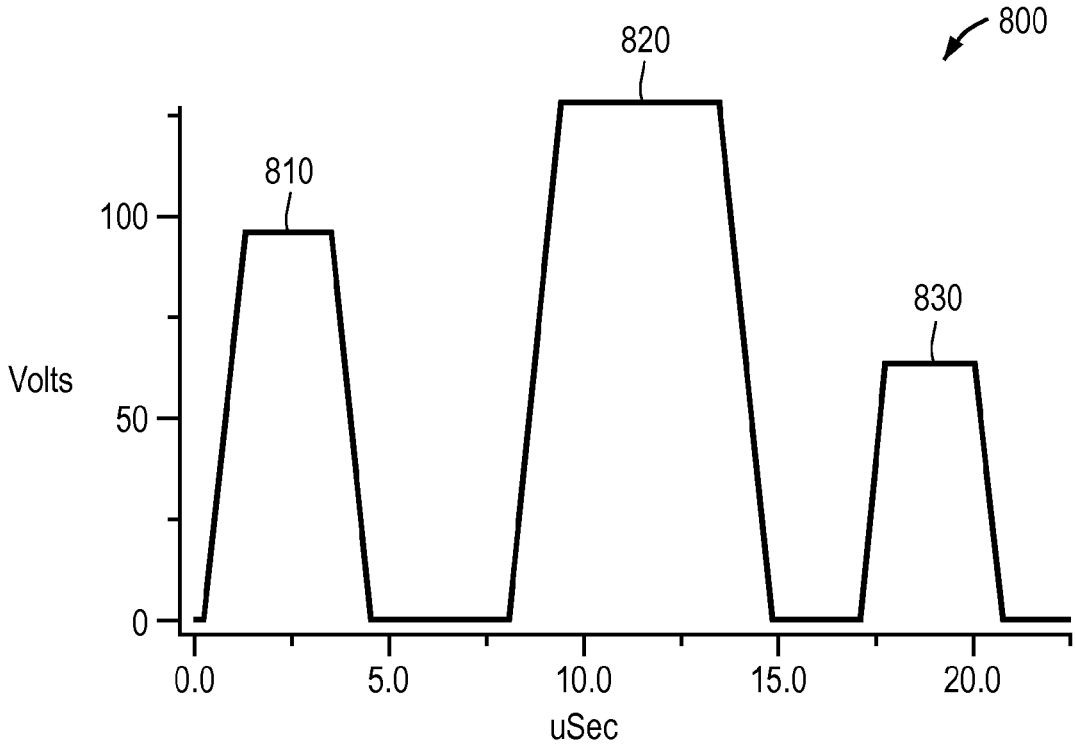
FIG. 8 illustrates a multi-pulse waveform with two drive pulses and one break off pulse in accordance with one embodiment.

FIG. 8 illustrates a multi-pulse waveform with two drive pulses and one break off pulse in accordance with one embodiment. During operation, each ink jet may jet a single drop in response to a multi-pulse waveform. An example of a multi-pulse waveform is shown in FIG. 8. In this example, multi-pulse waveform 800 has three pulses. Each multi-pulse waveform would typically be separated from subsequent waveforms by a period corresponding to an integer multiple of the jetting period (i.e., the period corresponding to the jetting frequency). Each pulse can be characterized as having a "fill" ramp, which corresponds to when the volume of the pumping element increases, and a "fire" ramp (of opposite slope to the fill ramp), which corresponds to when the volume of the pumping element decreases. In multi-pulse waveform 800 there is a sequence of fill and fire ramps. Typically, the expansion and contraction of the volume of the pumping element creates a pressure variation in the pumping chamber that tends to drive fluid out of the nozzle.

In certain embodiments, the multi-pulse waveform 800 has drive pulses 810 and 820 and break off pulse 830 fired to cause the drop ejection device to eject the drop of the fluid in response to the pulses as illustrated in FIG. 8. In one embodiment, the drive pulse 810 has a peak voltage of approximately 95 volts, and the drive pulse 820 has a peak voltage of approximately 125 volts, and the break off pulse 830 has a peak voltage of approximately 60 volts. The two drive pulses occur prior to the one break off pulse in the multi-pulse waveform 800. In other embodiments, additional drive pulses or fewer drive pulses (e.g., a single drive pulse) occur prior to one or more break off pulses. In one embodiment, a peak voltage of the break off pulse 830 is less than a peak voltage of the first drive pulse 810 which is less than a peak voltage of the second drive pulse 820. The drop may have a mass less than 40 nanograms (ng) that is a reduced tail mass drop. The drive pulses 810 and 820 form a larger drop that is reduced in mass with the break off pulse 830. In certain embodiments, other waveform configurations may be considered. A first drive pulse may have a higher peak voltage than a second drive pulse. The voltage minimum between drive pulses (e.g., pulse 810 and 820 in FIG. 8) may be greater than zero. In an embodiment, more than two drive pulses may be used to produce the drop. In some applications, the one or more drive pulses may be negative or the break-off pulse may be negative.

One advantage of the waveform 800 is that the tail mass of the drop is substantially reduced. Reduced tail mass drops will place more of the fluid on a target, thereby improving overall system performance. In one embodiment, the waveform 800 produces a 30 ng drop from an ejector that nominally produces a 30 ng drop for a particular printhead and ink type. The waveform 800 first builds a drop that would be 40-50 ng with the pulses 810 and 820. Then, an early break off of the tail is initiated with the break off pulse 830. In one embodiment, the break off pulse 830 occurs approximately 4 to 8 microseconds after the drive pulse 820. The break off pulse 830 prevents a smooth extraction of a tail from the nozzle, reduces the overall drop mass back to 30 ng, and increases the fraction of mass in a head of the drop. For other embodiments, more than one break off pulse can be used for possible greater effect.

In an embodiment, a break off pulse can be used to reduce drop mass for a drop firing at a given velocity. For example, a droplet device fires a drop at a given velocity (e.g., 8 m/s) with a nominal 30 ng drop mass. There is little variation available from the nominal 30 ng drop mass for the given velocity without a break off pulse. With the breakoff pulse, the drop velocity can be maintained and the drop mass reduced (e.g., less than 30 ng).

Figure 9:
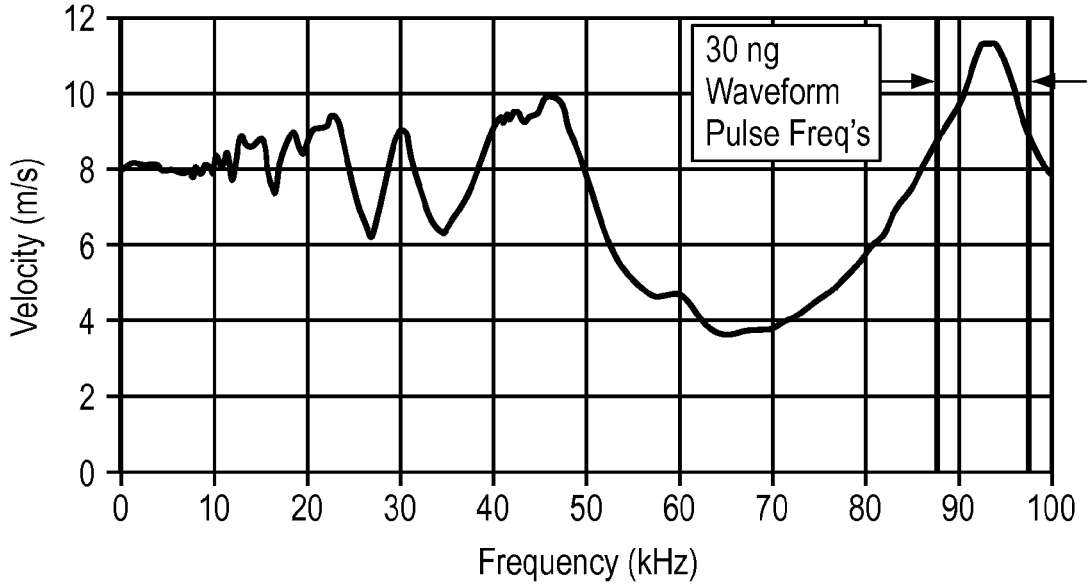
FIG. 9 illustrates a drop velocity versus frequency response graph in accordance with one embodiment.

In one embodiment, the drop ejection device operates at high frequencies such as frequencies up to or greater than 40 kHz. In an embodiment, the drop ejection device operates at frequencies greater than 100 kHz. FIG. 9 illustrates a drop velocity versus frequency response graph in accordance with this embodiment. The spacing between the pulses of a multi-pulse waveform effectively defines a frequency for the waveform, though the spacing is not necessarily constant. The effective pulse frequency can be calculated as follows.

$$\text{Frequency}=1/\text{Time},$$

where Time is the time between the pulses.

This graph shows that there may be limitations to the pulse frequencies that will work effectively in a drop ejection device. In one embodiment, the drive pulses 810 and 820 are tuned at approximately a last maximum drop velocity in the frequency response of the drop ejection device. This is necessary to keep the overall waveform time short, which is a requirement for high frequency operation.

The break off pulse 830 is tuned at approximately a minimum drop velocity in a frequency response of the drop ejection device. This frequency (not shown) is approximately 160 kHz for this embodiment. At this frequency, the jet velocity response, which is characterized by the drop velocity, is approximately zero. For this reason, the break off pulse 830 does not tend to eject a sub-drop, or satellite drop. Rather, the break off pulse 830 travels to an ejection nozzle and accelerates the break off of the drop that is already forming. In other embodiments, a frequency response of the droplet ejection device is lower for the break off pulse(s) than for the drive pulse(s).

An amount of drop mass in a head of the drop is based on various factors such as a peak voltage of the break off pulse, delay from drive pulse to break off pulse, number of break off pulses, and pulse width of break off pulses. A single pulse waveform typically has a drop head mass fraction of 60 percent with the remaining 40 percent of the mass being in the tail.

A multi-pulse waveform typically has a head mass fraction of 80 percent. As discussed above, a multi-pulse waveform has a higher head mass fraction because the drop formation process is being interrupted by the sequence of pulses that are used to produce the drop. This interferes with a smooth separation of a tail of the drop from the nozzle, and reduces the mass in the tail of the drop.

Figure 10:
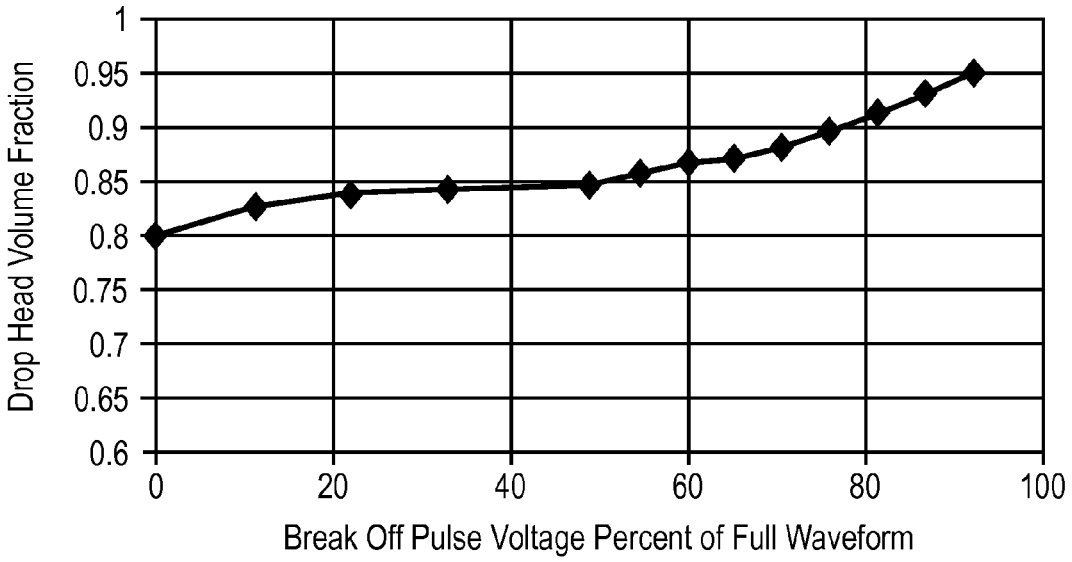
FIG. 10 illustrates a drop head mass fraction versus break off pulse voltage graph in accordance with one embodiment.

FIG. 10 illustrates a drop head mass fraction versus break off pulse voltage graph for a multi-pulse waveform in accordance with one embodiment. For a multi-pulse waveform with no break off pulse, the head mass fraction is approximately 80 percent. FIG. 10 illustrates that an amount of drop mass in the head of the drop is based on a peak voltage of the break off pulse with the amount of the drop mass in the head of the drop increasing as the peak voltage of the break off pulse increases. The drop has more than 80 percent of the drop mass in the head of the drop for a break off pulse voltage greater than zero. In one embodiment, a voltage break off pulse that is approximately 95 percent of the maximum waveform voltage results in a head mass fraction of approximately 95 percent and corresponding tail mass fraction of approximately 5 percent. This represents a 75 percent reduction in tail and satellite mass compared to using no break off pulse, which has a tail mass fraction of 20 percent.

In another embodiment, a break off pulse voltage is between 30 and 50 percent of the maximum waveform voltage such that the drop head fraction is increased compared to having no break off pulse while maintaining drop formation, drop velocity, and coalesced properties. As described above, a drop ejection device ejects drops of different sizes quantified by mass, weight, and/or volume that are fired at a particular velocity such that each drop lands on a target with the same relative timing compared to the timing of the fired pulse.

It is to be understood that the above description is intended to be illustrative, and not restrictive. Many other embodiments will be apparent to those of skill in the art upon reading and understanding the above description. The scope of the invention should, therefore, be determined with reference to the appended claims, along with the full scope of equivalents to which such claims are entitled.

What is claimed is:

1. A method for driving a drop ejection device having an actuator and a nozzle, comprising:

applying a multi-pulse waveform to the actuator, the waveform having at least two drive pulses and at least one break off pulse following the at least two drive pulses;

building a drop of a fluid with the at least two drive pulses; and accelerating the break off of the drop forming at the nozzle using the at least one break off pulse without causing formation of a sub-drop, wherein the drop ejection device to operate at a frequency of at least thirty kilohertz, wherein at least one of the at least two drive pulses is tuned at approximately a maximum drop velocity in the frequency response of the drop ejection device and the break off pulse is tuned at approximately a minimum drop velocity in the frequency response of the drop ejection device.

2. The method defined in claim 1 wherein a jet response of the nozzle for the break off pulse is approximately zero.

3. The method of claim 1, further comprising:

causing the drop ejection device to eject the drop in response to the pulses of the multi-pulse waveform, wherein the drop ejection device to operate at a frequency of at least forty kilohertz.

4. The method of claim 3, further comprising causing the drop ejection device to eject additional drops of the fluid in response to the pulses of the multi-pulse waveform.

5. The method of claim 1, wherein the multi-pulse waveform further comprises two drive pulses followed by two break off pulses.

6. The method of claim 5, wherein a peak voltage of the break off pulse is less than a peak voltage of the first drive pulse which is less than a peak voltage of the second drive pulse.

7. The method of claim 6, wherein the first and second drive pulses form a larger drop that is reduced in mass by the break off pulse.

8. The method of claim 7, wherein the break off pulse prevents a smooth extraction of a tail of the drop from an ejection nozzle and increases a fraction of mass in a head of the drop.

9. An apparatus, comprising:

an actuator to eject a drop of a fluid from a pumping chamber; and drive electronics coupled to the actuator, wherein during operation the drive electronics drive the actuator with a multi-pulse waveform having at least two drive pulses and at least one break off pulse to build a drop of a fluid with the at least two drive pulses and to accelerate the break off of the drop forming at a nozzle using the at least one break off pulse without the at least one break off pulse causing formation of a sub-drop, wherein the apparatus to operate at a frequency of at least thirty kilohertz, wherein at least one of the at least two drive pulses is tuned at approximately a maximum drop velocity in the frequency response of the apparatus and the break off pulse is tuned at approximately a minimum drop velocity in the frequency response of the apparatus.

10. The apparatus of claim 9 wherein a jet response of the nozzle for the break off pulse is approximately zero.

11. The apparatus of claim 9, wherein the drive electronics to cause the actuator to eject the drop in response to the pulses of the multi-pulse waveform, wherein the apparatus to operate at a frequency of at least forty kilohertz.

12. The apparatus of claim 9, wherein the multi-pulse waveform further comprises at least two drive pulses that occur prior to two break off pulses.

13. The apparatus of claim 12, wherein a peak voltage of the break off pulse is less than a peak voltage of the first drive pulse which is less than a peak voltage of the second drive pulse in order to eject the drop that is a reduced tail mass drop.

14. The apparatus of claim 13, wherein the drop has more than 80 percent of the drop mass in the head of the drop.

15. The apparatus of claim 9, wherein an amount of drop mass in the drop head is based on a peak voltage of the break off pulse with the amount of the drop mass in the head of the drop increasing as the peak voltage of the break off pulse increases.

16. A printhead, comprising:

an ink jet module that comprises, an actuator to eject a drop of a fluid from a pumping chamber; and drive electronics coupled to the actuator, wherein during operation the drive electronics drive the actuator with a multi-pulse waveform having at least two drive pulses and at least one break off pulse to build a drop of a fluid and to accelerate the break off of the drop forming at a nozzle using the at least one break off pulse without the at least one break off pulse causing formation of a sub-drop, wherein the ink jet module to operate at a frequency of at least thirty kilohertz, wherein at least one of the at least two drive pulses is tuned at approximately a maximum drop velocity in the frequency response of the ink jet module and the break off pulse is tuned at approximately a minimum drop velocity in the frequency response of the ink jet module.

17. The apparatus of claim 16 wherein a jet response of the nozzle with the break off pulse is approximately zero.

18. The printhead of claim 16, wherein the drive electronics to cause the actuator to eject the drop in response to the pulses of the multi-pulse waveform, wherein the ink jet module to operate at a frequency of at least forty kilohertz.

19. The printhead of claim 18, wherein the multi-pulse waveform further comprises two drive pulses that occur prior to two break off pulses.

20. The printhead of claim 19, wherein the first break off pulse occurs approximately six microseconds after the second drive pulse in the multi-pulse waveform.

21. The printhead of claim 16, wherein the ink jet module further comprises: a carbon body, a stiffener plate, a cavity plate, a first flexprint, a nozzle plate, an ink fill passage, and a second flexprint.

22. The printhead of claim 16, wherein the actuator is operable to vary the pressure of the fluid in the pumping chamber in response to the pulses.

* * * * *